US007637370B2

(12) United States Patent
Mymka

(10) Patent No.: US 7,637,370 B2
(45) Date of Patent: Dec. 29, 2009

(54) PAINT BRUSH STORAGE AND TOOL DEVICE

(75) Inventor: Ronald Anthony Mymka, Winnipeg (CA)

(73) Assignee: David Melcom Semenchuk, Winnipeg MB ( * ) Notice: Subject to any disclaimer, the term of this patent is extended or adjusted under 35 U.S.C. 154(b) by 0 days.

(21) Appl. No.: 12/036,552

(22) Filed: Feb. 25, 2008

(65) Prior Publication Data

US 2009/0211931 A1 Aug. 27, 2009

(51) Int. Cl.
*B65D 83/10* (2006.01)

(52) U.S. Cl. ..... 206/361; 220/694

(58) Field of Classification Search ..... 206/15.2, 206/15.3, 361, 362, 362.1, 362.2, 362.3; 220/697, 694, 695

See application file for complete search history.

(56) References Cited

U.S. PATENT DOCUMENTS 5,038,955 A * 8/1991 Studer et al. ..... 220/736
5,244,090 A * 9/1993 Keith ..... 206/361
5,540,363 A * 7/1996 Wilson ..... 224/148.7
5,645,164 A * 7/1997 Hocking ..... 206/209
5,645,167 A * 7/1997 Conrad ..... 206/361
6,338,406 B1 * 1/2002 Zagar ..... 206/362.2
2004/0108236 A1 * 6/2004 Reed et al. ..... 206/361
2004/0188276 A1 * 9/2004 Petrehn ..... 206/15.3
2006/0000728 A1 * 1/2006 Lee ..... 206/361

* cited by examiner

*Primary Examiner*—Jacob K Ackun, Jr.
(74) *Attorney, Agent, or Firm*—Kyle R. Satterthwaite; Adrian D Battison; Michael R Williams

(57) ABSTRACT

A paint brush storage and tool device comprises first and second cover bodies having main walls, perimeter walls and a pivotal connection for movement into and out of a closed condition to enclose the head of a paint brush between the main walls with a handle of the paint brush extending though an opening defined in the perimeter walls with cover bodies in the closed condition. A latching mechanism is provided to latch the cover bodies together in the closed condition and a painting accessory tool is mounted to the cover bodies to facilitate use of the cover bodies as a handle of the painting accessory tool when mated together in the closed condition.

16 Claims, 4 Drawing Sheets

PAINT BRUSH STORAGE AND TOOL DEVICE

FIELD OF THE INVENTION

This invention relates to paint brush cases, and more particularly to a paint brush case incorporating one or more accessory tools into its construction to provide additional functionality.

BACKGROUND OF THE INVENTION

In the prior art, is known to use a foldable case or container having two shell-like halves movable between open and closed positions relative to one another to temporarily enclose the head of a paint brush, for example to facilitate cleanly storage or transport a used paint brush and its wet bristles. U.S. Pat. Nos. 5,540,363 and 6,338,406 show examples of cases or containers for holding paint brushes after use.

However, prior art paint brush cases have been typically designed with only the sole function of holding or storing a used paint brush in mind, and thus have not addressed other needs that may typically encountered when painting, particularly the need to carry not only paint brushes, but other painting tools as well, such as brush cleaners or combs, paint roller cleaners or scrapers.

SUMMARY OF THE INVENTION

According to a first aspect of the invention there is provided a paint brush storage and tool device comprising:

a first cover body comprising a first main wall;

a second cover body comprising a second main wall, at least one of the cover bodies comprising perimeter walls projecting from the main wall thereof;

a pivotal connection defined between the first and second cover bodies to allow pivoting of first and second cover bodies relative to one another about an axis of said pivotal connection into and out of a closed condition in which the cover bodies close together at the perimeter walls to enclose a volume of space, sized to contain the head of a paint brush therein, between the main walls thereof;

an opening defined in the perimeter walls to extend therethrough at a handle end of the cover bodies when in the closed condition to extend about a handle of the paint brush having its head enclosed between the main walls of the cover bodies;

a latching mechanism defined between the first and second cover bodies to latch the cover bodies together at a distance from the axis of the pivotal connection with said cover bodies in the closed condition; and a painting accessory tool mounted to the cover bodies and arranged therewith for use of the cover bodies as a handle of the painting accessory tool when mated together in the closed condition.

The painting accessory tool may comprise a paint brush cleaner, a paint brush comb, a paint roller cleaner or a scraper.

Preferably the painting accessory tool is mounted to the first main wall of the first cover body at an external side thereof opposite the enclosed volume of space with the cover bodies in the closed condition.

Preferably the painting accessory tool is movably mounted to the first cover body for movement between a storage position and an operational position.

Preferably the painting accessory tool projects beyond a tool end of the first cover body in the operational position to situate a working end of the painting accessory tool outward from the first cover body.

Preferably the working end of the painting accessory tool is situated within a periphery of the first main wall in the storage position, Preferably the painting accessory tool is pivotally mounted to the first cover body to pivot along the first main wall thereof.

Preferably the painting accessory tool is movably mounted to the first cover body for movement along the first main wall thereof, the first main wall having stops defined thereon to block movement of the painting accessory tool past the storage and operational positions.

Preferably a portion of the first main wall along which the painting accessory tool moves is recessed, edges of the recessed portion defining the stops.

Preferably a depth by which the recessed portion of the first main wall is recessed exceeds a thickness of the painting accessory tool.

Preferably the recessed portion of the first main wall comprises two sections, the painting accessory tool being pivotal to lie substantially within opposite ones of the two sections in the operational and storage positions.

Preferably the recessed portion of the first side wall comprises an L-shaped recess having two legs extending along adjacent peripheral edges of the first main wall, the painting accessory tool extending along opposite ones of the two legs in the operational and storage positions.

Preferably there is provided a second painting accessory tool mounted to the cover bodies.

Preferably the painting accessory tools are mounted to opposite ones of the cover bodies.

The painting accessory tools may be mounted proximate a common end of the cover bodies and are each movably mounted for movement between a storage position and an operational position.

Preferably the first and second cover bodies comprise first and second perimeter walls projecting from the first and second main walls thereof respectively, the first perimeter walls comprising first inner perimeter walls arranged to fit within the second perimeter walls when the cover bodies are moved into the closed condition.

Preferably the first perimeter walls further comprise first outer perimeter walls projecting from the first main wall outside the first inner perimeter walls to bring distal edges of the first outer perimeter walls opposite the first main wall against corresponding distal edges of the second perimeter walls of the second cover body during relative movement of the cover bodies into the closed condition.

Preferably the second cover body further comprises second inner perimeter walls projecting from the second main wall a lesser distance than the second perimeter walls and inward therefrom to bring distal edges of the second inner perimeter walls opposite the second main wall against corresponding distal edges of the first inner perimeter walls during relative movement of the cover bodies into the closed condition.

BRIEF DESCRIPTION OF THE DRAWINGS

In the accompanying drawings, which illustrate an exemplary embodiment of the present invention.

DETAILED DESCRIPTION

Figure 1:
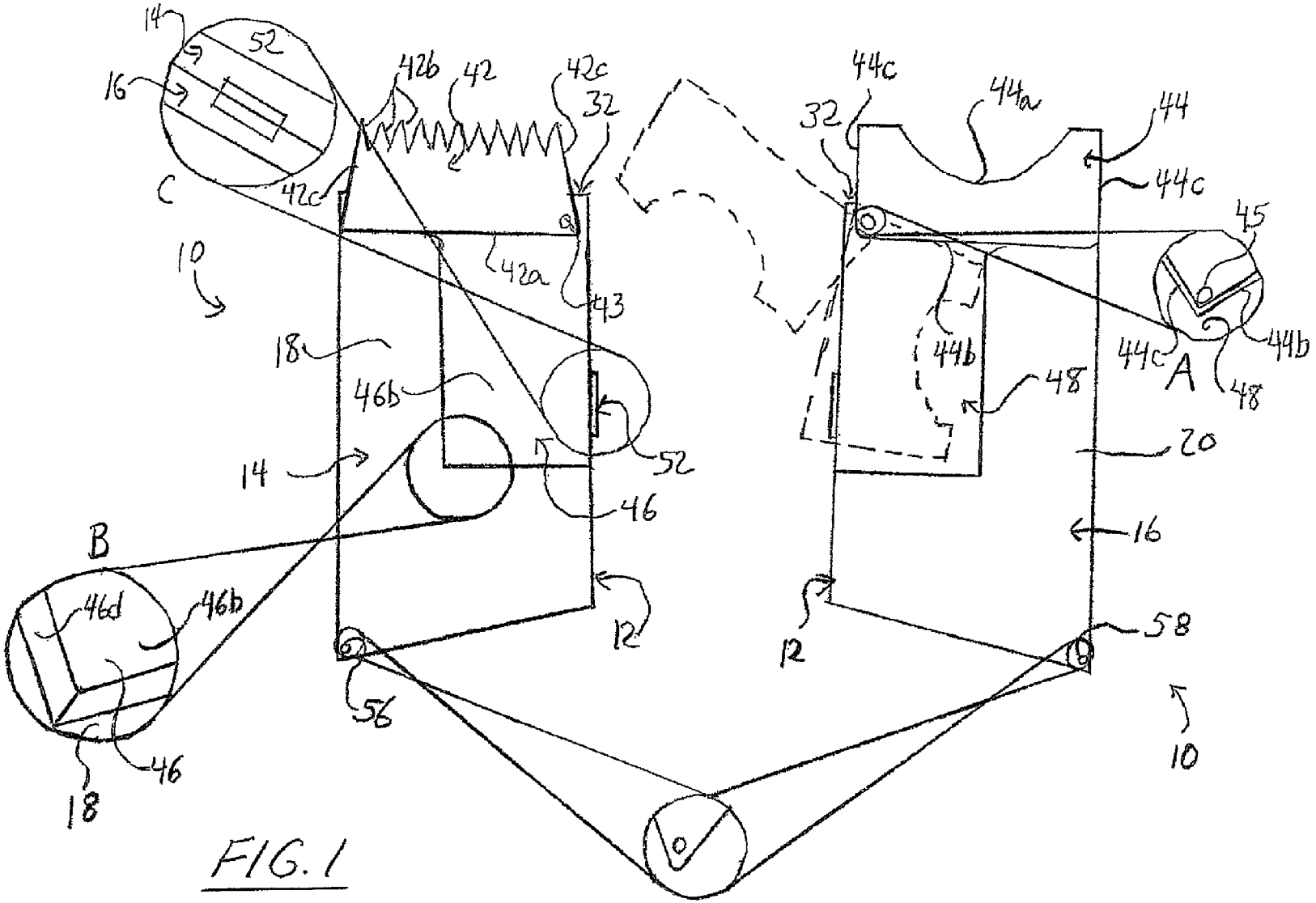
FIG. 1 shows opposing side views of a paint brush storage and tool device with a case of the device in a closed condition, the two side views showing opposite ones of two accessory tools deployed into an operational position.
Figure 2:
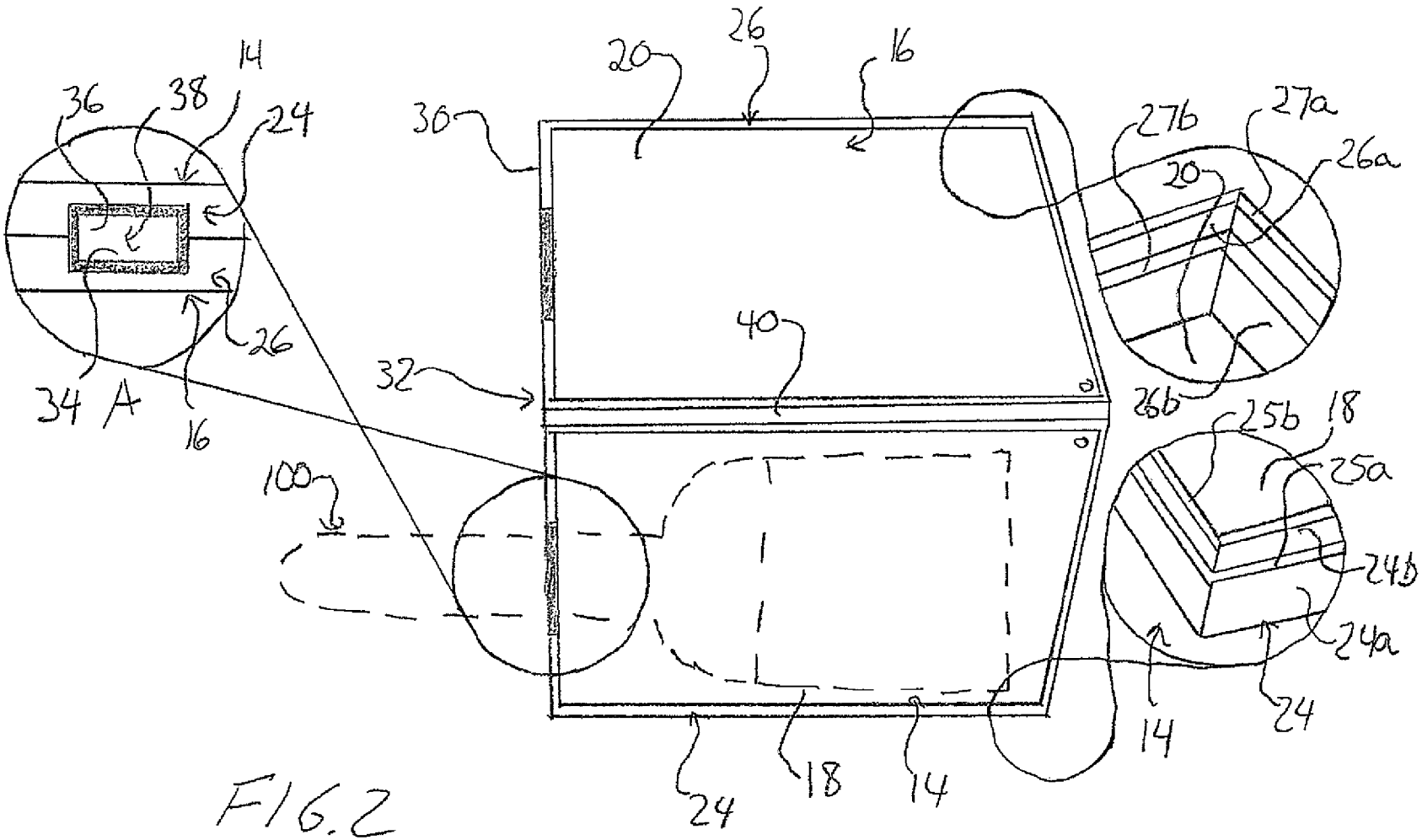
FIG. 2 shows the case of the paint brush storage and tool device of FIG. 1 in an open condition, a locking mechanism of the case being omitted for ease of illustration.

FIG. 1 shows opposing side views of a paint brush storage and tool device 10 according to an embodiment of the present invention. The device 10 features a folding case 12 made up of two shell-like cover bodies 14,16 pivotally connected to one another to facilitate folding or pivoting together of open sides of the two cover bodies 14,16 from an open condition, seen in FIG. 2, to the closed condition of the other figures. So closed together, the cover bodies 14,16 enclose a volume of space between main walls 18,20 thereof facing one another across the enclosed space. As shown in FIG. 2, these main walls 18, 20 share a common shape and are each sufficiently sized in plan to each span an area sufficient to have the head of a paint brush, shown in broken lines at 100, lay flat atop the main wall.

Two sets of perimeter walls 24, 26 are formed respectively on the main walls 18,20 of the two cover bodies 14,16 each having planar rectangular walls arranged end to end to extend along the perimeter edges of the respective main wall and project perpendicularly therefrom to a common side thereof. The two cover bodies 14,16 close against one another at these perimeter walls 24,26. End walls 28,30 of these perimeter walls are formed on the two main walls 18,20 at a common end 32 of the case 12 and feature notches 34,36 cut away from there distal edges opposite the main walls 18,20 at positions along these end walls 28,30 that align when the two cover bodies 14,16 are closed together, so that the these notches 34,36 together form an opening 38 through the end walls 28,30 at the common end 32 of the case 10 when closed (see detail Circle A of FIG. 2).

As shown in FIG. 2, this allows the head of the paint brush 100 to be laid atop one of the main walls 18,20 within a cavity defined within the respective set of perimeter walls with the paint brush handle projecting outward therefrom through the notch in the respective end wall. The other cover body is then pivoted about the pivotal connection 40 defined between the two cover bodies 14,16 to close against the cover body together supporting the paint brush 100 to enclose the head thereof within the volume bounded by the main and perimeters walls of the two cover bodies with the paint brush handle projecting out from this enclosed space through the opening 38 in the end walls 28,30.

Painting accessory tools 42,44 are mounted to the cover bodies 14,16 of the case 12 at its exterior, as shown in FIG. 1. In the illustrated embodiment, tool 42 mounted to cover body 14 is a paint brush comb formed of an aluminum plate having a linear side edge 42*a*, a serrated side edge opposite the linear side edge 42*a* and defining a plurality of teeth 42*b* projecting away therefrom, and two end edges 42*c* extending obliquely between the side edges 42*a*,42*b* in a converging manner from the linear side edge 42*a* toward the serrated side edge 42*b*. Tool 44 of the illustrated embodiment is a paint roller cleaner formed of an aluminum plate having an elongated generally rectangular shape except for an arcuate edge 44*a* cut into the plate from a side edge thereof opposite a linear side edge 44*b*. Parallel end edges 44*c* connect the arcuately cut-away side edge and the intact linear side edge 44*b* at each end of the plate and form the shorter sides of the plate's original rectangular shape. The arcuate edge 44*a* does not extend the full length of the respective side edge of the plate to avoid forming sharpened acute-angled corners at the ends thereof. The radius of the arc cut into the plate of tool 44 approximates that of a paint roller so that the arcuate edge approximately matches the arc of the paint roller's circumference to allow scraping of paint from the roller along its rotational axis. The device 10 thus provides two useful paint accessory tools; the brush comb 42 and the roller cleaner 44 of the illustrated embodiment facilitating the cleaning of a paint brush or paint roller using the same device that can be used to store or transport a paintbrush therein.

As shown in FIG. 1, the tools 42,44 are mounted to their respective main walls 18,20 of the two cover bodies 14,16 by respective pivot pins 43,45, which may for example be formed by aluminum rivets. The tools are pivotally mounted to the respective main walls 18,20 in respective recessed portions 18*a*,20*a* in the exterior sides of the respective main walls 18,20 (the exterior side referring to the side of the main wall facing away from the main wall of the other cover body when the cover bodies are in the closed condition). The recessed portion 46 of the outer face of main wall 18 of cover body 14 may be best illustrated in FIG. 3, where the case 12 of the device is shown in perspective. Recess portion 46 appears L-shaped when directly facing the outer side of cover body 14 straight on, having a first rectangular leg 46*a* extending fully across main wall 18 along and at the tool supporting end of the case 12, which in the illustrated embodiment corresponds to the same end 32 at which the handle of a paint brush projects from the case when its head is enclosed therein. A second rectangular leg 46*b* of recess portion 46 intersects with the first leg 46*a* at a right angle thereto along and at a shorter of two parallel side edges of the case 12 extending from the tool end edge 32 thereof at ninety degrees toward an opposite end of the case 12.

Figure 3:
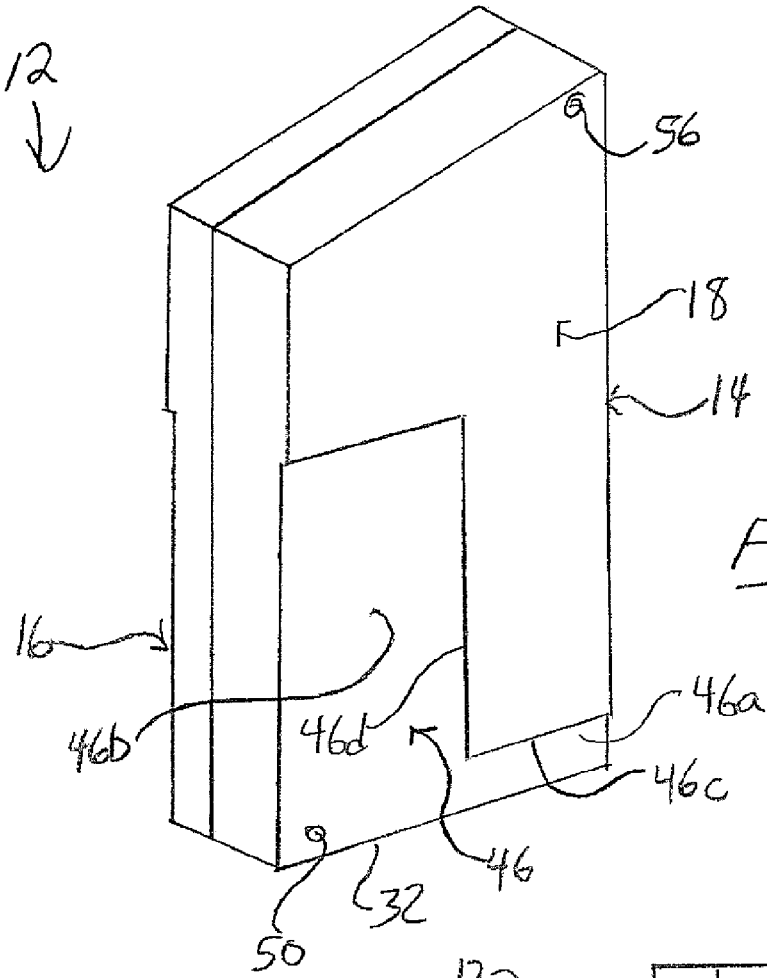
FIG. 3 is a side perspective view of the case of FIG. 2 in the closed condition.
Figure 4:
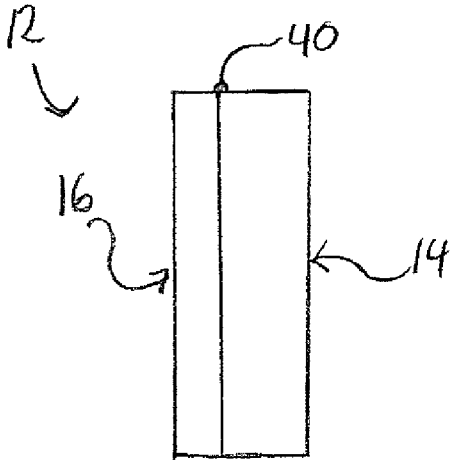
FIG. 4 is a top end view of the case of FIG. 2 in the closed condition.
Figure 5:
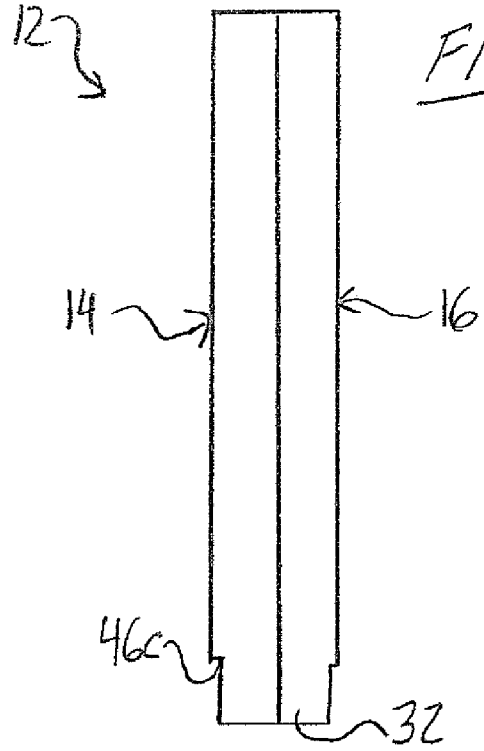
FIG. 5 is a front view of the case of FIG. 2 in the closed condition.
Figure 6:
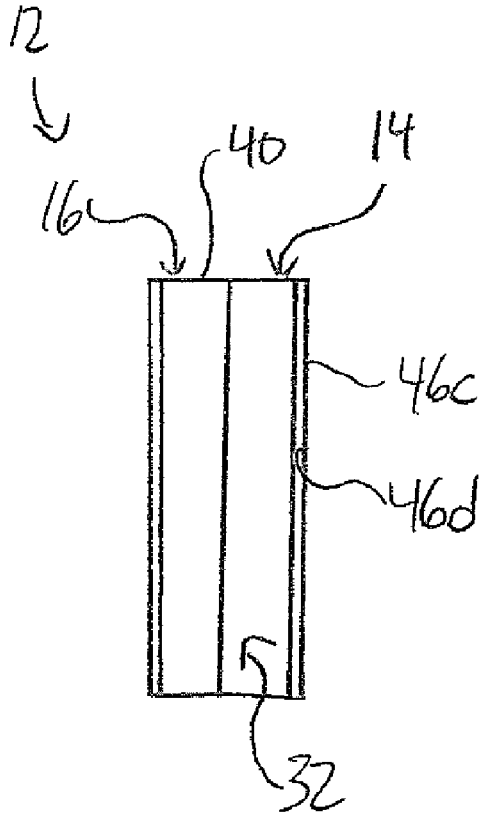
FIG. 6 is a bottom end view of the paint brush storage and tool device of FIG. 1 in the closed condition.
Figure 7:
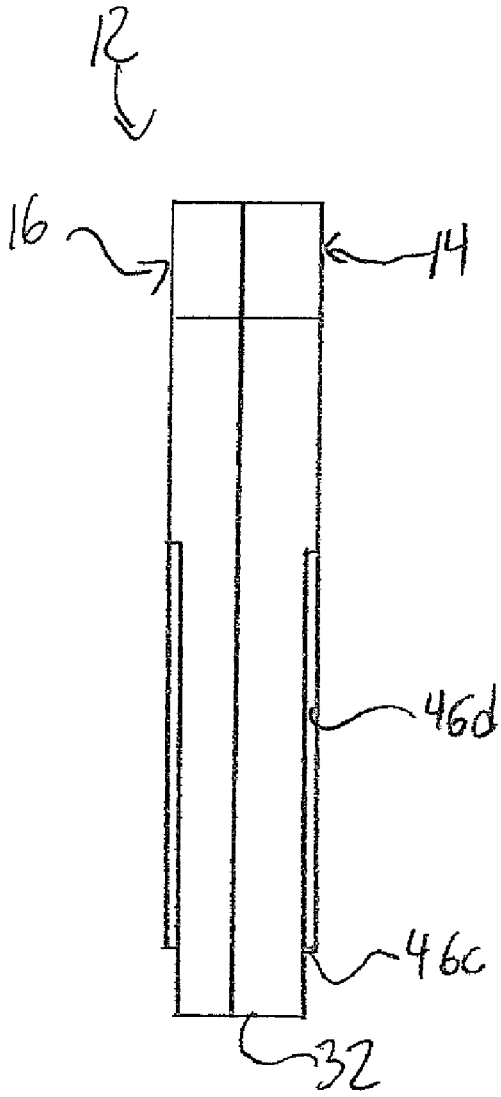
FIG. 7 is a rear view of the case of FIG. 2 in the closed condition.

With reference to FIGS. 1 and 3, a through-hole 50 is formed in main wall 18 at the recessed portion 46 thereof just obliquely inward from the corner of main wall 18 defined at the intersection of the tool end 32 of the case 12 and the shorter side edge thereof, thereby defining the position at which pivot pin 43 is installed. The width of the first leg 46*a* of recess portion 46, measured from the tool end edge 32 of the case 12 toward the opposite end edge thereof, is less than a width of the second leg 46, measured from the shorter side edge of the of the case 12 toward the opposite side thereof, and more specifically is less than the width of respective tool 42, measured between the opposite sides 42*a*, 42*b* thereof. The position of the pivot pin 43 inward from the tool end 32 of the case 12 is such that the linear side edge 42*a* of tool 42 extends parallel to the tool end 32 of the case 12 with tool 42 pivoted sufficiently in one direction about the axis of the pivot pin along the recess portion 46 of main wall 18 to bring the linear side edge 42*a* into physical contact with edge 46*c* defined parallel to tool end 32 of the case at the boundary between the first leg 46*a* of the recessed portion 46 of main wall 18 and the unrecessed portion thereof. As illustrated in FIG. 1, this position of tool 42 corresponds to an in-use or operational position in which tool 42 projects beyond the tool end 32 of the case to situate the tool's working end, as defined by the teeth 42*b* at the serrated side thereof in the illustrated embodiment, outward from the case 12.

Referring to FIGS. 1 and 3, pivoting of tool 42 ninety degrees out of the operational position of FIG. 1 in a sliding like motion over the recessed surface in which it is mounted brings the teeth 42*b* of the serrated side edge into physical contact with edge 46*d* defined parallel to the shorter side edge of the case at the boundary between the second leg 46*b* of the recessed portion 46 of main wall 18 and the unrecessed portion thereof. The width of the second leg 46*b* exceeds that of tool 42 so that, in this position, the tool is disposed entirely over the main wall 18 of cover body 14 within the perimeter of the closed case 12 so as not to project therefrom. This storage position of tool 42 not only brings the device into a more compact state, decreasing its footprint by reducing its planar size along the exterior face of main wall 18, but also greatly reduces the potential for injury by pointing the working end of tool 42 inward for abutting against edge wall 46*d* of the recess. In the illustrated embodiment, the depth of recessed portion 46 from the planar unrecessed surface of the outer side of main wall 18, or in other words the height of the recess walls 46*c*, 46*d*, is no less than the combination of the thickness of tool 42 and any clearance provided between tool 42 and the planar bottom surface of the recessed portion. This increases carrying comfort by not having tool 42 situated laterally outward from the case when stowed away in the storage position. The edge walls of the recessed portion define stops on main wall 18 acting to block motion of the tool past either of the storage or operational positions from the opposite position, thereby limiting movement of tool to pivoting motion between these two positions. The length of the second leg 46*b* of recessed portion 46 is sufficient to allow pivoting of tool 42 thereinto, without extending excessively far beyond this length (for example, fully to the end opposite the tool end 32). This acts to increase a consistency in the thickness of the case between the outer faces of its main walls when in the closed position with the tool stored away, by limiting the span of the recessed portion according to its intended function as a storage space or cavity for the tool. In the illustrate embodiment, the first leg 46*a* of the recess portion 46 extends the full width of the case from its shorter side edge to its longer side edge because the tool spans nearly this full width of the device when in the operational position.

As shown in FIG. 1, the arrangement of tool 44 and the outer side of main wall 20 of the opposite cover body 16 is substantially the same, the operational position of tool 44 being shown in solid lines with pivotal movement around pivot pin 45 into the storage position being illustrated in broken lines. In the illustrate embodiment, the recessed portions 46,48 of the outer faces of the cover bodies 14,16 are aligned such that they are provided at the same end 32 of the closed case with their second legs both extending along the shorter side edge thereof. It will be appreciated that the two tools 42,44 need not necessarily be mounted at the same end of the case or stow away along the same side edge thereof. With the tools 42,44 stowed in their storage position to bring the device into a compact state and protect a user from their working edges 42*b*,44*a*, the device can thus be used in the same context as a conventional hinged paint brush carrier or container. However, the device can also be used to carry out cleaning of a paint brush or roller using tool 42 or tool 44, with the closed case 12 acting as a handle by which the selected one of the tools can be maneuvered. The elongated shape of the case 12 in the direction between the tool end 32 and the opposite end increases gripping comfort for use of the closed case as a tool handle. It will be appreciated that in embodiments where paint brush handle opening 38 is not provided at the same portion of the case where one or more tools are mounted, it may be possible to make use of a tool through handling of the closed case even with a paint brush head housed therein. It will also be appreciated that the shape of the case and the shape and orientation of a tool accommodating recess may be altered while still retaining its portability, handheld configuration and slidably deployable tools. For example, the case need not have one side longer than the other in its elongate dimension as shown in the illustrated embodiment in order to have dimensions suitable for gripping within the hands of a typical user.

As shown in FIG. 1, a latching mechanism, schematically illustrated at 52, is supported on the cover bodies 14,16 and operable therebetween to selectively latch or secure the two cover bodies together in the closed condition Suitable latching or locking mechanisms are well known in the art and may be readily applied to the case 12 of the device 10. For example, a latching, locking or clasping mechanism originally separated and distinct from the case may be fastened thereto and operable to effect latching, locking or clasping after closing of the cover bodies 14,16 together, or a snap-fit type mechanism be incorporated into a plastic case with cooperative mating features defined on opposite ones of the cover bodies to automatically engage upon closing of the cover bodies together.

As shown in detail circles B and C of FIG. 2, each of the two sets of perimeter walls 24,26 includes inner and outer perimeter walls. With reference to detail circle B, the perimeter walls 24 of cover body 14 include outer perimeter walls 24*a* projecting perpendicularly from the main wall panel 18 of cover body 14 fully around the perimeter of main wall 18. Immediately adjacent and inward of the outer perimeter walls 24*a* are inner perimeter walls 24*b* projecting parallel thereto from main wall 18 farther than the outer perimeter walls 24*a*, but in the same direction. With reference to detail circle C, the perimeter walls 26 of cover body 16 similarly include outer perimeter walls 26*a* projecting perpendicularly from the main wall panel 20 of cover body 16 fully around the perimeter thereof. Immediately adjacent and inward of the outer perimeter walls 26*a* are inner perimeter walls 26*b* projecting parallel thereto from main wall 20 in the same direction, but not as far as, outer perimeter walls 26*a*.

The height difference between inner and outer perimeters walls 24*a*,24*b* of cover body 14 from the main panel 18 thereof matches the height difference between inner and outer perimeters walls 26*a*,26*b* of cover body 16 from the main panel 20 thereof. When the two cover bodies 14,16 are closed together distal edges or ends 25*a* of outer perimeter walls 24*a*, situated opposite the main wall 18 from which they project, are brought into contact against corresponding distal edges or ends 27*a* of outer perimeter walls 26*a*, situated opposite the other main wall 20 from which they project. Due to the equal differences in wall height on each of the two cover bodies 14,16, closing of the cover bodies also brings distal edges 25*b* of inner perimeter walls 24*b* into contact with the distal edges 27*b* of inner perimeter walls 26*b*. This mating together of two sets of inner perimeter walls at a different distance from the main wall of a cover body than mating together of two sets of outer perimeter walls provides an improved sealing effect between the two cover bodies 14,16 when closed together.

As illustrated in detail circle A of FIG. 2, the notches 34,36 formed in the perimeter walls 24,26 at the handle end 32 of the case 12 each span through both the inner and outer walls of the respective cover body in embodiments where the inner walls extend along the full perimeter of its main wall panel. The edges of each of these notches may be lined with flexible resilient foam 54 to provide a sealing effect around a paint brush handle sufficiently sized to engage against the foam in all directions around the opening 38 formed by the notches when the cover bodies 14,16 are closed. In the illustrated embodiment, each notch is a shallow elongated rectangle having its short sides extending perpendicularly into the respective perimeter wall set from the distal edges thereof, the resulting rectangular elongated rectangular opening 38 extending lengthwise along the perimeter walls at the handle end 32 of the case 12 to resemble the typically rectangular cross section of a conventional paint brush handle.

The illustrated embodiment features drain openings 56,58 provided in respective ones of the cover bodies 14,16, one per cover body extending through the main wall thereof proximate a corner thereof opposite the handle end 32 of the case 12 along the longer side edge thereof to allow water or solvent to drain out of the case 12 with a wet paintbrush head stored therein after cleaning.

The case may be 12 made of plastic, with the pivotal-like connection 40 between the cover bodies 14,16 provided by a flexible plastic spine spanning a sufficient distance between matching sides thereof to allow folding or pivoting along the spine to bring the two shell-like cover bodies into a face-to-face arrangement at their open sides to close against one another at their perimeter walls. It will be appreciated that other pivotal or hinge-like arrangements may alternatively be used, whether with a case formed of plastic or other materials, and that the pivotal-like connection between the cover bodies need not necessarily be provided at a different edge of the case than the handle opening or tool(s).

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A paint brush storage and tool device comprising:

a first cover body comprising a first main wall;

a second cover body comprising a second main wall, at least one of the cover bodies comprising perimeter walls projecting from the main wall thereof;

a pivotal connection defined between the first and second cover bodies to allow pivoting of first and second cover bodies relative to one another about an axis of said pivotal connection into and out of a closed condition in which the cover bodies close together at the perimeter walls to enclose a volume of space, sized to contain the head of a paint brush therein, between the main walls thereof;

an opening defined in the perimeter walls to extend therethrough at a handle end of the cover bodies when in the closed condition to extend about a handle of the paint brush having its head enclosed between the main walls of the cover bodies;

a latching mechanism defined between the first and second cover bodies to latch the cover bodies together at a distance from the axis of the pivotal connection with said cover bodies in the closed condition; and a painting accessory tool movably mounted to the first main wall of the first cover body at an external side thereof that is opposite the enclosed volume of space with the cover bodies in the closed condition, the painting accessory tool being slidable over the external side of the first cover body between an operational position in which the painting accessory tool is secured to the external side of the first cover body with a working end of the painting accessory tool situated outward from a periphery of the first main wall and storage position in which the painting accessory tool is secured to the external side of the first cover body with the working end of the painting accessory tool situated within the periphery of the first main wall, the painting accessory tool being arranged with the cover bodies for use of the cover bodies as a handle of the painting accessory tool when mated together in the closed condition.

2. The device according to claim 1 wherein the painting accessory tool is pivotally mounted to the first main wall to pivotally slide thereover during movement between the operational position and storage position.

3. The device according to claim 1 wherein the first main wall has stops defined thereon to block movement of the painting accessory tool past the storage and operational positions.

4. The device according to claim 3 wherein a portion of the first main wall along which the painting accessory tool moves is recessed, edges of the recessed portion defining the stops.

5. The device according to claim 4 wherein a depth by which the recessed portion of the first main wall is recessed exceeds a thickness of the painting accessory tool.

6. The device according to claim 4 wherein the recessed portion of the first main wall comprises two sections, the painting accessory tool being pivotal to lie substantially within opposite ones of the two sections in the operational and storage positions.

7. The device according to claim 6 wherein the recessed portion of the first side wall comprises an L-shaped recess having two legs extending along adjacent peripheral edges of the first main wall, the painting accessory tool extending along opposite ones of the two legs in the operational and storage positions.

8. The device according to claim 1 further comprising a second painting accessory tool mounted to the cover bodies.

9. The device according to claim 8 wherein the second painting accessory tool is mounted to the second main wall of the second cover body.

10. The device according to claim 9 wherein the painting accessory tools are mounted proximate a common end of the cover bodies and the second painting accessory tool is movably mounted for movement between a respective storage position and a respective operational position.

11. The device according to claim 1 wherein the painting accessory tool comprises a paint brush cleaner.

12. The device according to claim 1 wherein the painting accessory tool comprises a paint brush comb.

13. The device according to claim 1 wherein the painting accessory tool comprises a paint roller cleaner.

14. The device according to claim 1 wherein the first and second cover bodies comprise first and second perimeter walls projecting from the first and second main walls thereof respectively, the first perimeter walls comprising first inner perimeter walls arranged to fit within the second perimeter walls when the cover bodies are moved into the closed condition.

15. The device according to claim 14 wherein the first perimeter walls further comprise first outer perimeter walls projecting from the first main wall outside the first inner perimeter walls to bring distal edges of the first outer perimeter walls opposite the first main wall against corresponding distal edges of the second perimeter walls of the second cover body during relative movement of the cover bodies into the closed condition.

16. The device according to claim 15 wherein the second cover body further comprises second inner perimeter walls projecting from the second main wall a lesser distance than the second perimeter walls and inward therefrom to bring distal edges of the second inner perimeter walls opposite the second main wall against corresponding distal edges of the first inner perimeter walls during relative movement of the cover bodies into the closed condition.

* * * * *